US009252474B2

(12) United States Patent
Madeberg et al.

(10) Patent No.: US 9,252,474 B2
(45) Date of Patent: Feb. 2, 2016

(54) COUPLING ARRANGEMENT

(71) Applicant: Huawei Technologies Co., Ltd., Shenzhen, Guangdong (CN)

(72) Inventors: Bengt Madeberg, Stockholm (SE); Leif Bergstedt, Varberg (SE)

(73) Assignee: Huawei Technologies Co., Ltd., Shenzhen (CN)

( * ) Notice: Subject to any disclaimer, the term of this patent is extended or adjusted under 35 U.S.C. 154(b) by 158 days.

(21) Appl. No.: 14/143,200

(22) Filed: Dec. 30, 2013

(65) Prior Publication Data

US 2014/0111293 A1 Apr. 24, 2014

Related U.S. Application Data

(63) Continuation of application No. PCT/CN2011/076793, filed on Jul. 4, 2011.

(51) Int. Cl.

| | |
|---|---|
| ***H01P 5/107*** | (2006.01) |
| ***H01P 5/08*** | (2006.01) |
| ***H01P 5/02*** | (2006.01) |

(52) U.S. Cl.

CPC *H01P 5/107* (2013.01); *H01P 5/08* (2013.01); *H01P 5/028* (2013.01)

(58) Field of Classification Search

CPC ..... H01P 5/10; H01P 5/107; H01P 5/028; H01P 5/08; H01P 1/20354; H01P 3/121; H01P 3/08

USPC ..... 333/25, 26, 33, 113, 137, 157, 208, 333/239, 246, 24 R, 248

See application file for complete search history.

(56) References Cited

U.S. PATENT DOCUMENTS

| | | | | |
|---|---|---|---|---|
| 5,821,836 | A | 10/1998 | Katehi et al. | |
| 5,856,911 | A | 1/1999 | Riley | |
| 6,011,692 | A | 1/2000 | Bergstedt et al. | |
| 6,437,669 | B1 | 8/2002 | Welstand et al. | |
| 6,870,438 | B1 * | 3/2005 | Shino et al. | 333/26 |

FOREIGN PATENT DOCUMENTS

| | | | |
|---|---|---|---|
| CN | 1848030 | A | 10/2006 |
| CN | 101276957 | A | 10/2008 |
| WO | WO 2011/030277 | A2 | 3/2011 |

OTHER PUBLICATIONS

Hanna Yousef, et al., "Substrate Integrated Waveguides (SIWs) in a Flexible Printed Circuit Board for Millimeter-Wave Applications", Journal of Microelectromechanical Systems, vol. 18, No. 1, Feb. 2009, p. 154-162.

Tze-Min Shen, et al., A Laminated Waveguide Magic-T With Bandpass Filter Response in Multilayer LTCC, IEEE Transactions on Microwave Theory and Techniques, vol. 59, No. 3, Mar. 2011, p. 584-592.

Jing Fei, et al., "The Design of Ka-band LTCC Slot Antenna", IEEE ICMMT2008 Proceedings, Apr. 21, 2008, 3 pages.

* cited by examiner

*Primary Examiner* — Benny Lee
*Assistant Examiner* — Jorge Salazar, Jr.

(57) ABSTRACT

A coupling arrangement for the transfer of a microwave signal includes a motherboard having a first substrate with a first microstrip conductor, and a module having a second substrate with a second microstrip conductor. The module is attached to the motherboard such that the motherboard conductor by means of a connection is in electrical contact with the module conductor, whereby the microwave signal may be transferred between the motherboard conductor and the module conductor. The connection includes the motherboard conductor connected to a substrate integrated waveguide on the motherboard, which substrate integrated waveguide is connected to the module conductor via a slot coupling.

18 Claims, 3 Drawing Sheets

COUPLING ARRANGEMENT

CROSS-REFERENCE TO RELATED APPLICATION

This application is a continuation of International Application No. PCT/CN2011/076793, filed on Jul. 4, 2011, which is hereby incorporated by reference in its entirety.

TECHNICAL FIELD

The application relates to a coupling arrangement for a transfer of a microwave signal between a motherboard and a module.

BACKGROUND

To produce fully industrial high frequency microwave radio systems, it is a must to make them in a Surface Mount (SMT) process. This is due to several reasons:

To have as low "built-up-value" components in the final manufacturing as possible, in order to reduce cost, To lift out chip-attach technologies and wire-bonding from "in-house-manufacturing" at radio-manufacturers, since such technologies tend to be hard to automate, which also drives cost.

There are many different types of modules for microwave radio system that may be desired to be connected to a motherboard. One example is a package which may contain some kind of microwave electronics such as a filter or a microwave integrated circuit. Another type of module may be a smaller sub-board carrying several electrical components. All such modules, however, have in common that they must be connected to the main motherboard in such a way that microwave signals can be exchanged between them in an efficient way.

In the prior art surface mounted (SMT) microwave signal systems, the transferring of signals between a motherboard and a module, for instance a surface mounted package, is mostly based on connections from a microstrip to a Coplanar Waveguide to a microstrip. They work well up to around 40-50 GHz and with some limitations up to 60 GHz.

For microwave radios and automotive radar around 75-85 GHz and above another approach, Chip On Board (COB) solutions are mostly is used, i.e. the chip is directly mounted on and electrically interconnected to its final circuit board, instead of first being incorporated in a package that then can be mounted on a desired board. However, the chip on board model means higher technology in the end manufacturing and such solutions are also harder and more expensive to repair.

Such COB concepts allow SMT manufacturing of products that can transfer microwave signals with a frequency of up to around 120 GHz.

The prior art surface mounted module systems, mentioned above, will now be described a bit more with reference to FIGS. 1 and 2. They are based on a microstrip at the motherboard and also inside the package and an inter-connection by a Coplanar Waveguide system. In this way, the lower microstrip is lifted up to a higher microstrip. This concept gives losses and limitations when signal frequencies are passing somewhere around 40 GHz.

Such a prior art coupling arrangement 1*a* is shown in FIG. 1. It discloses a motherboard 2*a* comprising a substrate 3*a* and a microstrip 4*a*. The motherboard 2*a* is connected to a surface mount module 5*a*, said module comprising a substrate 6*a* and a microstrip conductor 7*a*. The connection 17*a* between the motherboard 2*a* and the module 5*a* is shown encircled with an oval in the figure. A via-hole 18*a* is shown interconnecting an underside with an upper side of the substrate 6*a* of the module 5*a*. In FIG. 1, X-X denotes a cross section through the connection 17*a*; this cross section is detailed in FIG. 2.

The cross section X-X of the connection between the motherboard and the module can be studied further in FIG. 2. The motherboard 2*a* is connected to the module 5*a* via a coplanar waveguide 20*a*. The coplanar waveguide 20*a* comprises two ground conductors 21*a* each comprising a solder pad on each of the motherboard and the module with solder in between. The ground can be seen transported from the motherboard ground plane 19*a* through the motherboard, by way of vias 22*a*, to the upper side of the motherboard. The coplanar waveguide 20*a* further comprises, in the same plane as the ground conductors 21*a*, a signal conductor 23*a* comprising the microstrip on the motherboard connected with solder to a via-hole 18*a* leading up to the microstrip 7*a* on the upper side of the module 5*a*.

This prior art arrangement is straightforward, however the transmission of signals from microstrip to Coplanar Waveguide to microstrip is hard to maintain with a "smooth" flow at higher frequencies, which results in losses.

SUMMARY

The present application proposes a solution for, or a reduction of, the problems of prior art by providing a coupling arrangement for a surface mounted device module that is suitable for transfer of signals with a high frequency.

This is attained with a slot-feed technology for input/output transmit signals to/from the module from/to the motherboard. This will give less loss than existing systems.

A coupling arrangement for transfer of a microwave signal includes a motherboard having a substrate with a microstrip conductor and a module 5 having a substrate with a microstrip conductor, wherein the module is attached to the motherboard such that the motherboard conductor by means of a connection is in electrical contact with the module conductor, whereby the microwave signal may be transferred between the motherboard conductor and the module conductor.

The connection includes the motherboard conductor connected to a substrate integrated waveguide on the motherboard, which substrate integrated waveguide is connected to the module conductor via a slot coupling.

By means of the application it is possible to have automatically assembled Surface Mount Device (SMD) modules for signals above 40 GHz and maybe up to 100 GHz and even higher, which is not possible with the prior art.

Further advantageous embodiments are disclosed in the claims.

BRIEF DESCRIPTION OF DRAWINGS

Embodiments exemplifying the application will now be described in conjunction with the appended drawings, on which.

DETAILED DESCRIPTION

Figure 1:
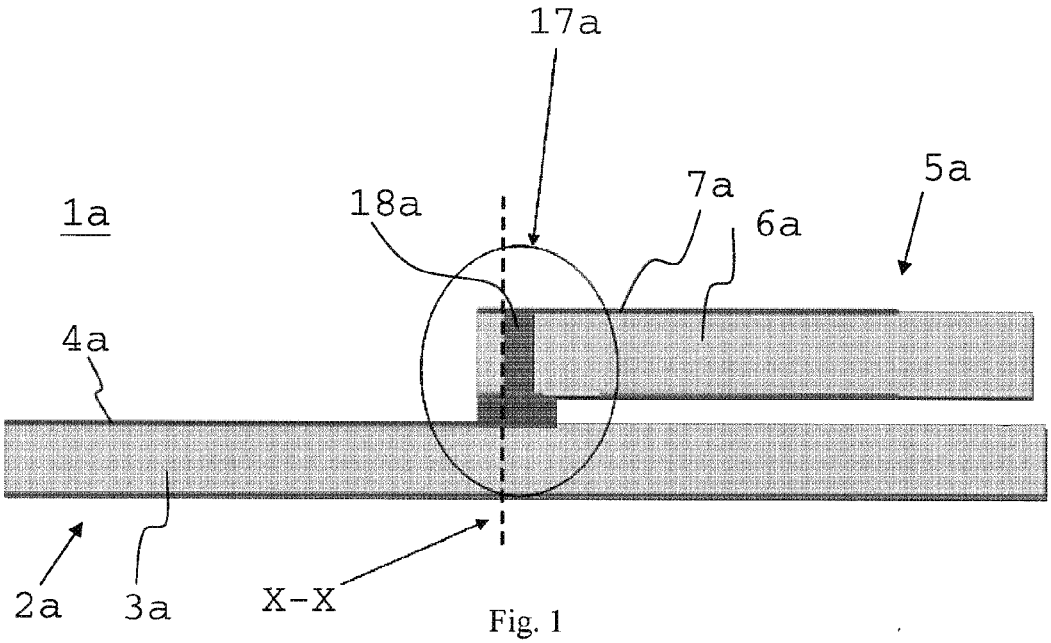
Fig. 1 (PRIOR ART)
FIG. 1 discloses a module connection according to prior art.
Figure 2:
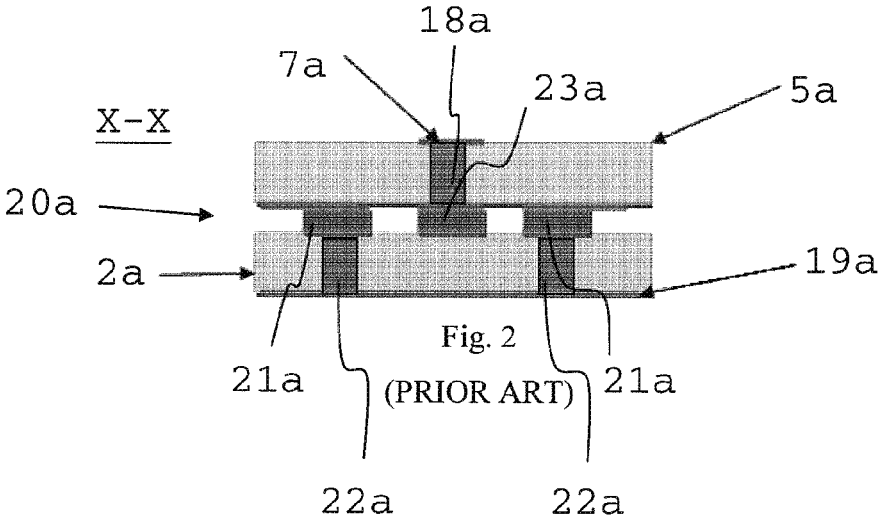
Fig. 2 (PRIOR ART)
FIG. 2 discloses a close-up cross section of FIG. 1.

Some embodiments exemplifying the application will now be described. Features that have a correspondence in the prior art will be referenced with the same numerals as in the prior art FIGS. 1 and 2.

Figure 3:
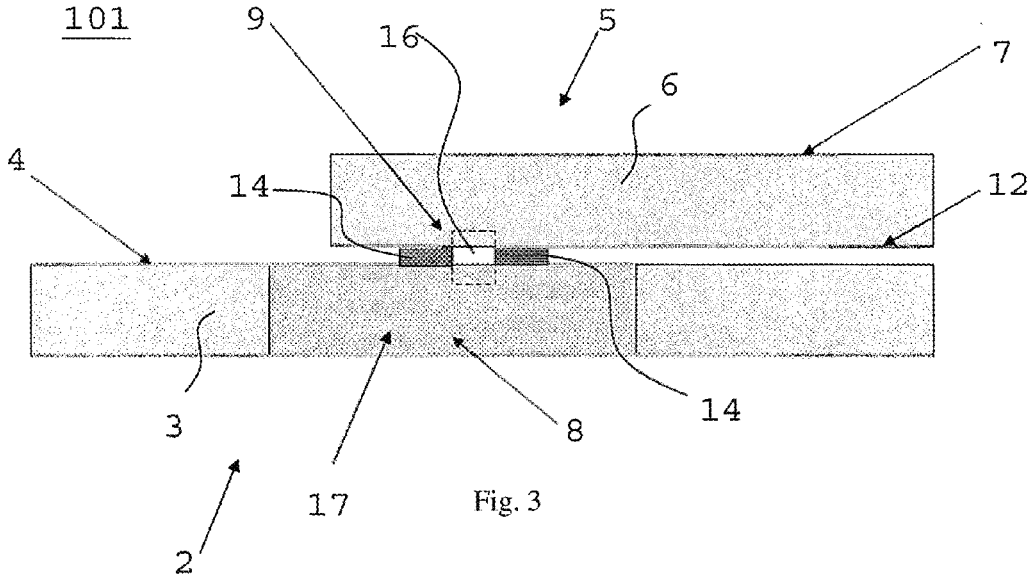
FIG. 3 discloses a side view of a portion of a module connected to a portion of a mother board, in accordance to the application.

In the present disclosure, a Substrate Integrated Waveguide (SIW) element is utilized to feed or be fed to/from a microstrip conductor via a slot coupling. FIG. 3 depicts a coupling arrangement 101 for transfer of a microwave signal according to the application. The arrangement 101 includes a motherboard 2 having a substrate 3 with a microstrip conductor 4, and a module 5 having a substrate 6 with a microstrip conductor 7.

The module 5 is attached to the motherboard 2 such that the motherboard conductor 4 by means of a connection 17 is in electrical contact with the module conductor 7, whereby the microwave signal may be transferred between the motherboard conductor 4 and the module conductor 7. According to the application, the connection 17 includes the motherboard conductor connected to a substrate integrated waveguide 8 on the motherboard 2, which substrate integrated waveguide 8 is connected to the module conductor 7 via a slot coupling 9.

A substrate integrated waveguide is an electromagnetic waveguide formed in a dielectric substrate by forming metalized trenches or densely arranging metalized via-holes connecting upper and lower metal planes of the substrate. These trenches or via-holes correspond to the metal walls of an ordinary hollow electromagnetic waveguide.

A slot coupling is a coupling that transmits electromagnetic waves from one place to another by means of an opening or slot in an electrically conductive layer. The slot allows electromagnetic waves to escape from the layer and to radiate away from it. Such slots have ordinarily been used in for instance the feeding of patch antennas. The aperture slot can be of different sizes and shape and these design parameters drive the bandwidth i.e. these parameters have an impact on the frequency content of the signal transmitted through the slot.

Figure 4:
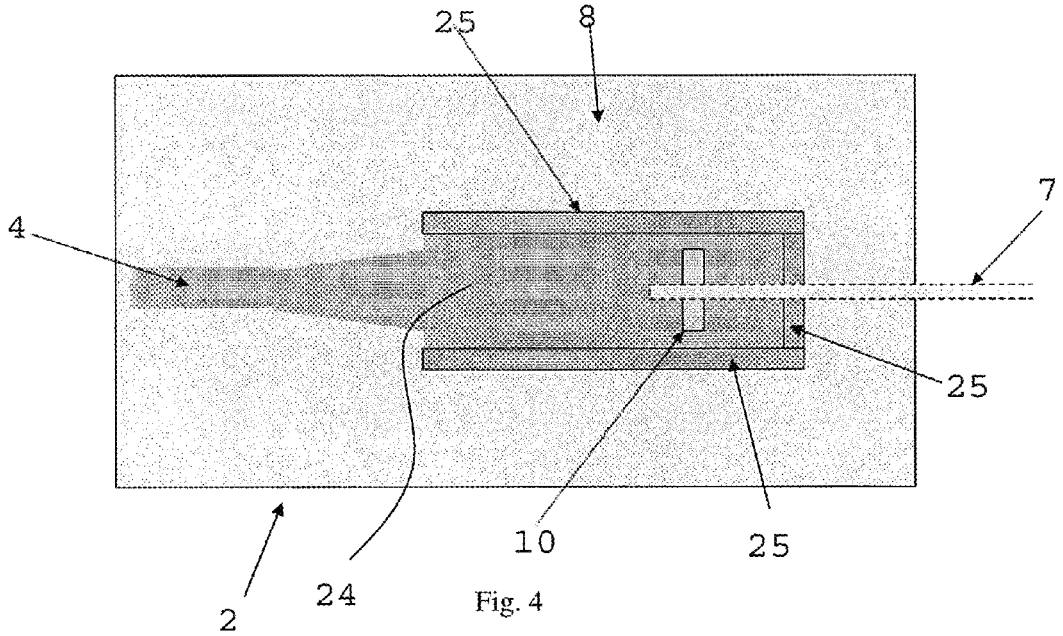
FIG. 4 discloses a top view of a portion of a mother board according to the application.
Figure 5:
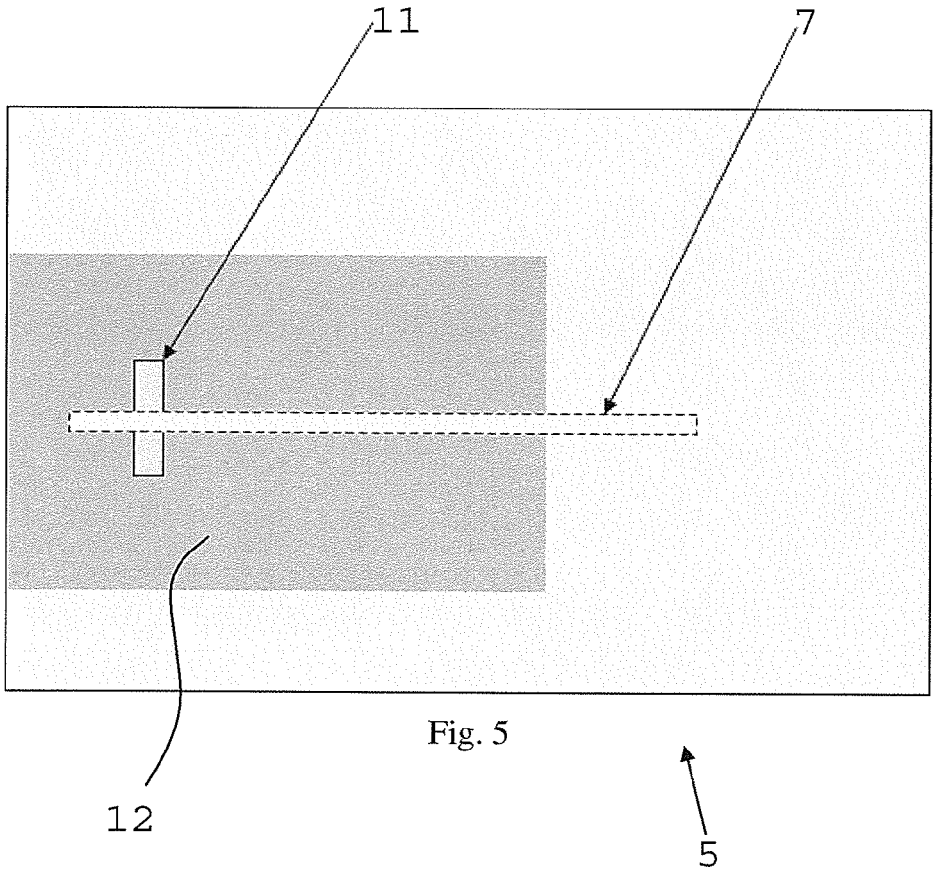
FIG. 5 discloses a bottom view of a portion of a module according to the application.

The parts of an embodiment of an arrangement according to the application can be studied in more detail in FIGS. 4 and 5.

FIG. 4 depicts the motherboard 2 from the side which is facing the module 5 in FIG. 3. The connection described in FIG. 3 entails the microstrip conductor 4 connected to the substrate integrated waveguide 8. The substrate integrated waveguide 8 comprises, in the same way as the microstrip conductor 4, a thin layer or foil 24 of electrically conducting material coated on the substrate of the motherboard. The substrate integrated waveguide 8 further includes trenches 25 that are plated with an electrically conducting material. Alternatively, the trenches 25 could be plated via-holes that are positioned at appropriate distances from each other in dependence on the frequency of the signal that is to be transmitted. In FIG. 4, the trenches are elongated rectangles that are formed all around the foil 24 except on the left hand of the figure where the microstrip 4 enters the substrate integrated waveguide. The trenches 25 run through the substrate of the motherboard 2 and are in electrical contact with a ground plane on the other side of the motherboard (not shown in FIG. 4).

In FIG. 5, the side of the module 5 which is facing the side of the motherboard in FIG. 4 is shown. It comprises a ground plane 12 with an open slot 11 in it. The microstrip conductor 7 of the module, situated on the side opposite of the ground plane 12 is shown as a dashed rectangle.

It should be noted that only the parts of the motherboard and the module respectively that are of interest to elucidate the coupling arrangement of the application are shown in FIGS. 3, 4 and 5. It is understood that in other parts of the motherboard and the module, other components are/maybe provided.

Further to the embodiment of the coupling arrangement 101 according to the application, FIGS. 4 and 5, the slot coupling 9 comprises a slot 10 in the substrate integrated waveguide 8 connected to a slot 11 in a ground plane 12 on a side of the module substrate 6. The two slots 10, 11 are connected by a connecting substance 14 (see FIG. 3) around their peripheries. This connection should be as thin as possible, as otherwise the slot will have waveguide properties, deteriorating performance. The module conductor 7 is situated opposite the ground plane slot 11 on a side of the module substrate 6 opposite the side with the ground plane 12. In this way, a microwave signal entering a microstrip 4 can be led into the substrate integrated waveguide 8, transferred via the slot coupling 9 (comprising the slots 10, 11 and the connecting substance 14) and feed the microstrip 7 of the module 5. The reverse order, leading a signal from the microstrip 7 to the microstrip 4 is equivalently possible.

When the coupling arrangement 101 with the slots 10, 11, is assembled, it is preferable that the slots 10 and 11 are aligned with each other. However, if a coupling arrangement 101 with slots 10, 11 should be assembled with a misalignment of the slots 10, 11, is may be compensated with walls of the connecting substance 14 between the slots 10, 11 that are oblique to a plane in parallel with any of the slots 10, 11. As the connecting substance will form after the top and bottom "solder-pads", the walls of the connecting substance part of the waveguide will compensate some "mismatch" by stretching obliquely between slots.

In any of the embodiments of the coupling arrangement 101 with the slots 10, 11 forming the slot coupling 9, the connecting substance 14 connecting the slots 10, 11 may be solder, which probably would be the normal case. However, other electrically conducting substances such as electrically conducting adhesive are also possible.

In FIG. 3, a small space 16 can be seen within the slot coupling 9. Whenever such as space 16 occurs in the coupling arrangement 101 according to any embodiment of the application, such a space 16 can be provided with a dielectric material instead of air. In this way, a better adaptation of the transition from the substrate of the motherboard to the substrate of the module or vice versa can be obtained, which would lessen the amount of reflections of a microwave signal that traverses the coupling arrangement.

A convenient way of applying such dielectric material when the slot coupling is made up of two slots 10, 11 connected to each other, would be printing the dielectric inside of the slot 10 of the substrate integrated waveguide 8. Alternatively, the printing of the dielectric could be in the slot 11 of the ground plane 12 of the module 5 or even in both slots 10, 11. Such printing could for instance accomplished by screen printing. When the slots 10, 11 are connected, a contraction of the connecting substance would let the dielectric material fill out the air between the slots.

If the dielectric material is printed such that there is a space between the dielectric material and a wall of the slot in which it is printed, there is a margin for misalignment of the slots when they are assembled to form the slot coupling. If the slots are assembled without misalignment, said space may be filled with solder paste, or other connecting substances may be used.

If, in any embodiment using a dielectric material in the slot coupling, the dielectric material has a relative permittivity within a range of +/−20% of the permittivity of the substrate of the motherboard or the module, the amount of reflected energy of a microwave signal traversing the coupling arrangement should be quite low. The best performance would be attained if the dielectric and the substrates of the motherboard and the module all have the same permittivity.

Normally, the coupling arrangement 101 according to any of the described embodiments would be provided wherein the module comprises a Microwave Monolithic Integrated Circuit. Such a circuit may for instance perform functions on microwave signals, such as mixing, power amplification, low noise amplification and high frequency switching.

In any of the above coupling arrangements according to the application, the module may for instance be a surface mount package or a sub-board.

It should be noted that the application concurrently also provides for an elegant connection of the ground plane of the motherboard to the ground plane of the module.

What is claimed is:

1. A coupling arrangement for transfer of a microwave signal, the arrangement comprising:

a motherboard comprising a substrate with a first microstrip conductor;

a module comprising a substrate with a second microstrip conductor;

wherein the module is attached to the motherboard such that the first microstrip conductor by means of a connection is in electrical contact with the second microstrip conductor, whereby the microwave signal may be transferred between the first microstrip conductor and the second microstrip conductor; and wherein the connection comprises the first microstrip conductor connected to a substrate integrated waveguide on the motherboard, and wherein the substrate integrated waveguide is connected to the second microstrip conductor via a slot coupling;

wherein the slot coupling comprises a slot in the substrate integrated waveguide connected to a slot in a ground plane on a side of the module substrate, wherein the slot in the substrate integrated waveguide and the slot in a ground plane are connected by a connecting substance having walls around peripheries of both slots, and wherein the second microstrip conductor is situated opposite the ground plane slot on another side of the module substrate.

2. The coupling arrangement according to claim 1, wherein the connecting substance connecting the slot in the substrate integrated waveguide and the slot in the ground plane is solder or electrically conducting adhesive.

3. The coupling arrangement according to claim 1, wherein the slot in the substrate integrated waveguide and the slot in the ground plane are aligned with each other.

4. The coupling arrangement according to claim 1, wherein a misalignment of the slot in the substrate integrated waveguide and the slot in the ground plane is compensated with the walls of the connecting substance between the slot in the substrate integrated waveguide and the slot in the ground plane that are oblique to a plane in parallel with any of the slot in the substrate integrated waveguide and the slot in the ground plane.

5. The coupling arrangement according to claim 1, wherein a space within the slot coupling is provided with a dielectric material.

6. The coupling arrangement according to claim 5, wherein the dielectric material has a relative permittivity within a range of +/−20% of the permittivity of the substrate of the motherboard or the module.

7. The coupling arrangement according to claim 5 wherein the dielectric material is printed inside one of the slots of the substrate integrated waveguide and the slot of the ground plane of the module substrate.

8. The coupling arrangement according to claim 7, wherein the dielectric material is printed such that there is a space between the dielectric material and a wall of a particular slot in which it is printed.

9. A coupling arrangement for transfer of a microwave signal, the arrangement comprising:

a motherboard comprising a substrate with a first microstrip conductor; and a module comprising a substrate with a second microstrip conductor;

wherein the module is attached to the motherboard such that the first microstrip conductor by means of a connection is in electrical contact with the second microstrip conductor, whereby the microwave signal may be transferred between the first microstrip conductor and the second microstrip conductor;

wherein the connection comprises the first microstrip conductor connected to a substrate integrated waveguide on the motherboard, and wherein the substrate integrated waveguide is connected to the second microstrip conductor via a slot coupling;

wherein the slot coupling comprises a slot in the substrate integrated waveguide disposed beneath a slot in a ground plane on a side of the module substrate opposite to the second microstrip conductor.

10. The coupling arrangement according to claim 9, wherein the module comprises a Microwave Monolithic Integrated Circuit.

11. The coupling arrangement according to claim 9, wherein the module is a surface mount package.

12. The coupling arrangement according to claim 9, wherein the substrate integrated waveguide is a thin layer or foil of electrically conducting material coated on the substrate of the motherboard.

13. The coupling arrangement according to claim 12, wherein the substrate integrated waveguide includes a trench surrounding the thin layer or foil of electrically conducting material except where the first microstrip conductor connects to the substrate integrated waveguide.

14. The coupling arrangement according to claim 13, wherein the trench runs through the substrate of the motherboard and is in electrical contact with a ground plane on an opposite side of the motherboard from the substrate integrated waveguide.

15. The coupling arrangement according to claim 12, wherein the substrate integrated waveguide includes a plurality of vias surrounding the thin layer or foil of electrically conducting material except where the first microstrip conductor connects to the substrate integrated waveguide.

16. The coupling arrangement according to claim 15, wherein the vias run through the substrate of the motherboard and are in electrical contact with a ground plane on an opposite side of the motherboard from the substrate integrated waveguide.

17. The coupling arrangement according to claim 15, wherein the vias are positioned at appropriate distances from each other in dependence on a frequency of the microwave signal that is to be transmitted through the slot coupling.

18. The coupling arrangement according to claim 9, wherein the slot in the substrate integrated waveguide and the slot in the ground plane are connected by a connecting substance around their peripheries, the connecting substance having a thickness so that the slot coupling does not produce waveguide properties.

* * * * *